US009128450B2

(12) United States Patent
Terada

(10) Patent No.: US 9,128,450 B2
(45) Date of Patent: Sep. 8, 2015

(54) IMAGE ERASING APPARATUS, IMAGE FORMING APPARATUS AND IMAGE ERASING METHOD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Kyosuke Terada, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/108,626

(22) Filed: Dec. 17, 2013

(65) Prior Publication Data

US 2014/0199103 A1 Jul. 17, 2014

(30) Foreign Application Priority Data

Jan. 11, 2013 (JP) ..... 2013-003484

(51) Int. Cl.
*G03G 21/00* (2006.01)
*G03G 15/00* (2006.01)

(52) U.S. Cl.
CPC ..... *G03G 21/00* (2013.01); *G03G 15/6585* (2013.01)

(58) Field of Classification Search
CPC ..... G03G 21/00; G03G 15/6585
USPC ..... 399/1, 2, 15, 341; 347/179
See application file for complete search history.

(56) References Cited

U.S. PATENT DOCUMENTS

| | | | | |
|---|---|---|---|---|
| 8,284,220 | B2 * | 10/2012 | Takayama et al. | 347/179 X |
| 2010/0272449 | A1 * | 10/2010 | Yoshida et al. | 399/2 |
| 2013/0077983 | A1 * | 3/2013 | Kashiwagi | 399/15 |
| 2014/0093293 | A1 * | 4/2014 | Yamaguchi et al. | 399/341 |
| 2014/0212192 | A1 * | 7/2014 | Umetsu | 399/341 |

FOREIGN PATENT DOCUMENTS

| | | |
|---|---|---|
| JP | 07-092865 | 4/1995 |
| JP | 07-239630 | 9/1995 |
| JP | 2010-181883 | 8/2010 |

OTHER PUBLICATIONS

Japanese Office Action for Japanese Patent Application No. 2013-003484 mailed on Dec. 18, 2014.

* cited by examiner

*Primary Examiner* — Sophia S Chen
(74) *Attorney, Agent, or Firm* — Amin, Turocy & Watson, LLP

(57) ABSTRACT

According to one embodiment, an image erasing apparatus includes an erasing unit to perform erasing processing to a sheet on which a specific pattern is formed with decoloring toner, a reading unit to read an image on the sheet to which the erasing processing is performed by the erasing unit, a detecting unit to detect erasing residue on the sheet, based on the image read by the reading unit, and a specific pattern forming unit to form a specific pattern again on the sheet, when the erasing residue is detected by the detecting unit.

10 Claims, 4 Drawing Sheets

IMAGE ERASING APPARATUS, IMAGE FORMING APPARATUS AND IMAGE ERASING METHOD

CROSS-REFERENCE TO RELATED APPLICATION

This application is based upon and claims the benefit of priority from the prior Japanese Patent Application No. 2013-003484, filed on Jan. 11, 2013, the entire contents of which are incorporated herein by reference.

FIELD

Exemplary embodiments described herein relate to an image erasing apparatus, an image forming apparatus and an image erasing method.

BACKGROUND

Conventionally, there is an image forming apparatus which forms an image using image forming material that can be erased (decolored) by prescribed erasing processing. In addition, in order to protect an image (security image) required for protection of duplication prohibition and so on, an image forming apparatus may form an image of a specific pattern such as an electronic watermark along with the security image. However, actually, erasable image forming material has not been erased completely, and thereby an erasing residue may be generated. When the specific pattern is erased by the erasing processing, and a part of the security image remains in the replicable state, the part of the security image might become in the illegally replicable state.

DETAILED DESCRIPTION

In general, according to one embodiment, there is provided an image erasing apparatus including: an erasing unit to perform erasing processing to a sheet on which a specific pattern is formed with decoloring toner; a reading unit to read an image on the sheet to which the erasing processing is performed by the erasing unit; a detecting unit to detect erasing residue on the sheet, based on the image read by the reading unit; and a specific pattern forming unit to form a specific pattern again on the sheet, when the erasing residue is detected by the detecting unit.

Hereinafter, embodiments will be described with reference to the drawings.

Figure 1:
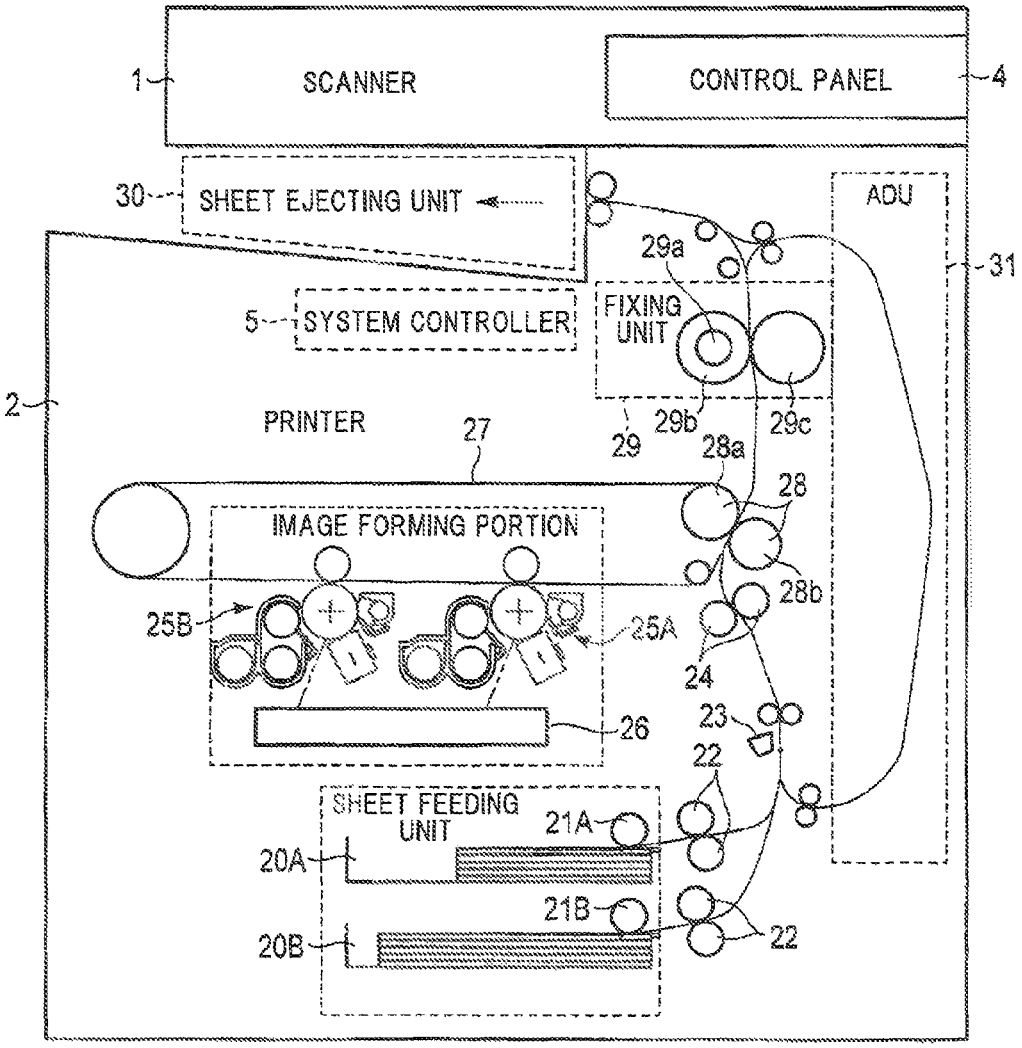
FIG. 1 is a sectional view showing schematically a configuration example of a digital multi-functional peripheral according to an embodiment.

FIG. 1 is a sectional view showing schematically a configuration example of a digital multi-functional peripheral according to an embodiment. The digital multifunctional peripheral (MFP, Multi-Functional Peripheral) functions as an image erasing apparatus and an image forming apparatus. As shown in FIG. 1, the digital multi-functional peripheral has a scanner 1, a printer 2, a control panel 4 and a system controller 5.

The scanner 1 is a device to read an image of a document and convert the read image into image data. The scanner 1 is composed of such as a CCD line sensor which converts an image on a reading surface of a document into image data, for example. The scanner 1 may be one that scans a document loaded on a document table glass, or may be one that reads an image of a document conveyed by an auto document feeder (ADF: Auto Document Feeder). The scanner 1 is installed at an upper portion of a main body of the digital multi-functional peripheral, for example. The scanner 1 is controlled by the system controller 5. The scanner 1 outputs the image data of the document to the system controller 5.

The printer 2 functions as an image forming apparatus, an image decoloring apparatus (image erasing apparatus), or an image forming apparatus having a decoloring function. The printer 2 has an image forming function to form an image on a sheet as a medium on which an image is formed, and an image decoloring function to decolor (erase) an image printed on a sheet. The printer 2 is able to perform image forming, as the image forming function, by selecting either decoloring toner as image forming material that can be decolored by the image decoloring function, or ordinary toner as image forming material that can not be decolored by the image decoloring function. In addition, the image forming function of the printer 2 may be one that performs image forming with the decoloring toner, or one which performs image forming with the ordinary toner.

In the configuration example shown in FIG. 1, the printer 2 has sheet feed cassettes 20 (20A, 20B). Each of the sheet feed cassettes 20A, 20B is provided at a lower portion of the main body of the digital multi-functional peripheral in the detachable state. Each of these sheet feed cassettes 20A, 20B houses a sheet for printing an image, as a medium on which an image is formed. Each of the sheet feed cassettes 20A, 20B houses not only a new sheet on which an image is to be formed by the image forming function (a sheet not required for performing image decoloring processing), but also a sheet on which an image which can be decolored by the image decoloring function has been printed (a sheet required for performing image decoloring processing). As an operation form, a new sheet may be housed in one sheet feed cassette, and a sheet on which a decolorable image has been printed may be housed in the other sheet feed cassette, or a new sheet and a sheet on which a decolorable image has been printed may be housed in the both (or any one of) cassettes in the mixed state.

The sheet feed cassettes 20A, 20B have pick-up rollers 21A, 21B, respectively. The pick-up rollers 21A, 21B take out sheets one by one from the sheet feed cassettes 20A, 20B, respectively. Each of the pick-up rollers 21A, 21B feeds the taken-out sheet to a conveying path (conveyor) 22 composed of a plurality of conveying rollers and so on. The number of the sheet feed cassettes and the pick-up rollers as a sheet feeding unit are not limited to two, respectively. The sheet feed cassette and the pick-up roller may be provided by one, or may be provided by three or more, respectively. In addition, the sheet feeding unit may be a manual feed tray, in addition to the sheet feed cassette.

The conveyor 22 conveys a sheet within the printer 2. The conveyor 22 conveys the sheet fed from any of the pick-up rollers 21A, 21B to an image reading position of a scanner 23. The conveyor 22 conveys the sheet which has passed through the image reading position of the scanner 23 to an alignment roller 24. In the case of forming an image on a sheet, the alignment roller 24 conveys the sheet to a transfer position at the timing of transferring the image. But, in the case of not forming an image on a sheet (for example, in the case of decoloring an image printed on a sheet, or in the case of rejecting the relevant sheet), the alignment roller 24 conveys the sheet as one conveying roller composing the conveyor 22.

The scanner 23 is an image reading unit composed of a CCD line sensor and so on. The scanner 23 reads an image on the sheet conveyed by the conveyor 22 at the prescribed image reading position. A sheet fed from the sheet feed cassette 20, or a sheet which is resupplied by an ADU 31 described later is conveyed to the image reading position of the scanner 23. The scanner 23 functions as second image reading unit to read an image on a sheet fed from the sheet feed cassette 20, and also functions as image reading unit to read an image on a sheet (sheet after erasing processing) which is resupplied by the ADU 31.

Image forming portions 25 (25A, 25B), an exposure unit 26, an intermediate transferring belt 27, and a transferring unit 28 function as image forming means or specific pattern forming means which operates in the case of forming an image on a sheet. When an image is not formed on a sheet conveyed from the alignment roller 24, but an image printed on the relevant sheet is decolored (that is, in the case of operating as the image decoloring function), the image forming portions 25 (25A, 25B), the exposure unit 26, the intermediate transferring belt 27, and the transferring unit 28 do not perform the operation related to printing, except that the transferring unit 28 functions as a conveying roller.

Each of the image forming portions 25 (25A, 25B) forms an image which is to be transferred on a sheet. The image forming portion 25A forms an image with decolorable toner (referred to as decoloring toner), for example. The image forming portion 25B forms an image with toner which can not be decolored (referred to as ordinary toner). Each of the image forming portions 25 (25A, 25B) may be one that forms a monochrome image, or may be one that forms a color image. For example, the image forming portion 25A may be composed of a plurality of image forming portions each of which forms an image with decoloring toner of each color composing a color image. In addition, the image forming portion 25B may be composed of a plurality of image forming portions each of which forms an image with ordinary toner of each color composing a color image.

The exposure unit 26 forms, with laser light, an electrostatic latent image that is to be developed with decoloring toner or ordinary toner on a photoconductor drum as an image carrier in each of the image forming portions 25 (25A, 25B). The exposure unit 26 irradiates the photoconductor drum with laser light which is controlled in accordance with the image data through an optical system such as a polygon mirror. An electrostatic latent image is formed on the surface of the photoconductor drum on which the laser light has been irradiated. The exposure unit 26 controls the laser light in accordance with a control signal from the system controller 5. For example, the exposure unit 26 controls the power of the laser light in accordance with a control signal from the system controller 5. In addition, the exposure unit 26 controls the modulation amount of a pulse width, and so on, for controlling emission of the laser light in accordance with a control signal from the system controller 5.

Each of the image forming portions 25 (25A, 25B) develops the electrostatic latent image formed on each of the photoconductor drums with toner (decoloring toner, ordinary toner), to form a toner image (a decoloring toner image, an ordinary toner image) as a visible image. The intermediate transferring belt 27 is an intermediate transfer body. Each of the image forming portions 25 (25A, 25B) transfers (primarily transfers) the toner image formed on each of the photoconductor drums on the intermediate transferring belt 27. A transfer bias controlled by a transfer current is applied to a primary transfer position of the toner image with the decoloring toner or the ordinary toner. The toner image on each of the photoconductor drums is transferred on the intermediate transferring belt 27 at each of the primary transfer positions by the transfer bias. Each of the transfer currents used in the primary transfer processing can be controlled by the system controller 5.

In addition, each of the image forming portions 25A, 25B has sensors such as a potential sensor and a concentration sensor. The potential sensor is a sensor to detect a surface potential of the photoconductor drum. In each of the image forming portions 25A, 25B, before the photoconductor drum is exposed by the exposure unit 26, the surface thereof is charged by an electrifying charger. The charging condition of the electrifying charger can be changed by a control signal from the system controller 5. The potential sensor detects the surface potential of the photoconductor drum after the surface thereof has been charged by the electrifying charger. The concentration sensor detects the concentration of the toner image transferred on the intermediate transferring belt 27. In addition the concentration sensor may be one which detects the concentration of the toner image formed on the photoconductor drum.

In addition, in the case of the configuration to form a color image, the image forming portions for the respective colors transfer (primarily transfer) the toner images (visible images) that have been developed with the decoloring toners or the ordinary toners of the respective colors (yellow, magenta, cyan, black, for example) on the intermediate transferring belt 27 in an overlapped manner. By this means, the intermediate transferring belt 27 holds a color image (a color image with decoloring toners or a color image with ordinary toners) in which toner images with the decoloring toners or the ordinary toners of the respective colors are overlapped with each other.

The transferring unit 28 transfers the toner image (the decoloring toner image or the ordinary toner image) on the intermediate transferring belt 27 to a sheet at a secondary transfer position. The secondary transfer position is a position where the toner image on the intermediate transferring belt 27 is transferred to a sheet. The secondary transfer position is a position where a support roller 28*a* and a secondary transferring roller 28*b* are opposite to each other. A transfer bias controlled by a transfer current is given to the secondary transfer position. The toner image (the coloring toner image or the ordinary toner image) on the intermediate transferring belt 27 is transferred from the intermediate transferring belt 27 onto a sheet at the secondary transfer position by the transfer bias. The transfer current used in the secondary transfer processing can be controlled by the system controller 5. For example, the system controller 5 may individually control the transfer current in the case of transferring the decoloring toner image, and the transfer current in the case of transferring the ordinary toner image.

A fixing unit 29 has a fixing processing function (a function as a fixing unit) to make the toner image to be fixed on a sheet as fixing means, and a decoloring processing function (a function as an erasing unit) to decolor an image on a sheet as decoloring means. In the embodiment, it is assumed that an image on a sheet is decolored by heat applied by the fixing unit 29. But, the decoloring (erasing) processing of an image is not limited to a processing in which the fixing unit 29 decolors the image by heat. For example, the decoloring (erasing) processing may be a processing performed by an erasing unit which takes off image forming material from on the sheet surface to erase an image, or may be a processing performed by an erasing unit which coats material that chemically decolors the image forming material on a sheet. That is, it is only necessary that the image forming apparatus is provided with a fixing unit to make a toner image to be fixed and an decoloring unit to comply with a system of decoloring processing. In addition, in the description of the present embodiment, it is assumed that an image on a sheet can be decolored by heat, and the fixing unit 29 functions also as an erasing unit.

In the case of forming an image on a sheet (in case that the printer 2 operates in the image forming function), the alignment roller 24 conveys a sheet to the secondary transfer position while matching the timing with the toner image (the decoloring toner image or the ordinary toner image) on the intermediate transfer belt 27. The transferring unit 28 supplies the sheet on which the toner image has been transferred at the secondary transfer position to the fixing unit 29. In this case, the fixing unit 29 performs fixing processing to fix the toner image on a sheet.

In addition, in the case of decoloring an image (a decoloring toner image) formed on a sheet (in case that the printer 2 operates in the image decoloring function), the alignment roller 24 and the transferring unit 28 convey a sheet in the state in which the fixing unit 29 can decolor the image. In this case, the fixing unit 29 performs decoloring processing to decolor the toner image (decoloring toner image) formed on a sheet.

The fixing unit 29 has a configuration to give heat to a sheet so as to make a toner image to be fixed to a sheet, or make a toner image on a sheet to be decolored. In the configuration example shown in FIG. 1, the fixing unit 29 is composed of a heat roller 29*b* incorporating a heating unit 29*a*, and a pressing roller 29*c* which contacts the heat roller 29*b* in the pressurized state. The heating unit 29*a* may be a temperature controllable heater. For example, the heating unit 29*a* may be composed of a heater lamp such as a halogen lamp, or may be an induction heating (IH) system heater. In addition, the heating unit 29*a* may be composed of a plurality of heaters. In addition, the fixing unit 29 may be a configuration in which a fixing unit for fixing processing to make a toner image to be fixed on a sheet, and a fixing unit for decoloring processing to make a decoloring toner image to be decolored are provided individually.

The fixing unit 29 configured described above can be controlled by the system controller 5 to either a fixing temperature used for the fixing processing, or a decoloring temperature used for the decoloring processing. But, it is assumed that the fixing temperature for making the decoloring toner to be fixed on a sheet and the decoloring temperature for making the decoloring toner image on a sheet to be decolored are at least different. And it is assumed that a sheet whose image forming (printing) and decoloring are determined unnecessary passes through the fixing unit 29 without performing the image forming processing and the decoloring processing, and is ejected to a sheet ejecting unit 30.

For example, in the case of performing the fixing processing to make a toner image to be fixed to a sheet, the system controller 5 controls the fixing unit 29 to the fixing temperature. While pressurizing a sheet on which a toner image has been transferred by the transferring unit 28, the fixing unit 29 which is controlled to the fixing temperature heats the sheet at the fixing temperature. By this means, the fixing unit 29 makes the toner image to be fixed to the sheet. In addition, the fixing unit 29 conveys the sheet after fixing processing to either the sheet ejecting unit 30 or the automatic duplex unit 31. In the case of forming an image on a rear face of a sheet after fixing processing by the fixing unit 29, the relevant sheet is once conveyed to the sheet ejecting unit 30 side, and then is switched back and conveyed to the ADU 31. In this case, the ADU 31 feeds again the sheet which has been reversed by the switchback to a position in front of the alignment roller 24.

In addition, in the case of performing the decoloring processing to decolor decoloring toner image formed on a sheet, the system controller 5 controls the fixing unit 29 to the decoloring temperature. While pressurizing a sheet on which a decoloring toner image has been formed, the fixing unit 29 which is controlled to the decoloring temperature heats the sheet at the decoloring temperature. The fixing unit 29 can convey the sheet after the decoloring processing to either the sheet ejecting unit 30 or the automatic duplex unit (ADU) 31. But, in the present embodiment, it is assumed that the sheet after the decoloring processing by the fixing unit 29 is resupplied to the image reading position of the scanner 23 so as to confirm the decolored state of the sheet. That is, in the present embodiment, the fixing unit 29 conveys the sheet after the decoloring processing to the ADU 31 in the unchanged state (without reversing the front and back). The ADU 31 conveys the sheet to which the fixing unit 29 has performed the decoloring processing to a position in front of the image reading position of the scanner 23 again.

The control panel 4 is a user interface. The control panel 4 is controlled by the system controller 5. The control panel 4 outputs information which a user has inputted to the system controller 5. The user designates an operation mode or inputs information such as setting information on the control panel 4. For example, it is assumed that the user can instruct, on the control panel 4, a decoloring operation mode to perform decoloring processing to a sheet housed in the sheet feed cassette 20A, 20B, and to make the sheet to be ejected to the sheet ejecting unit 30, and a decoloring image forming mode to form an image on the sheet after decoloring processing.

Next, a configuration of a control system of the digital multi-functional peripheral will be described.

Figure 2:
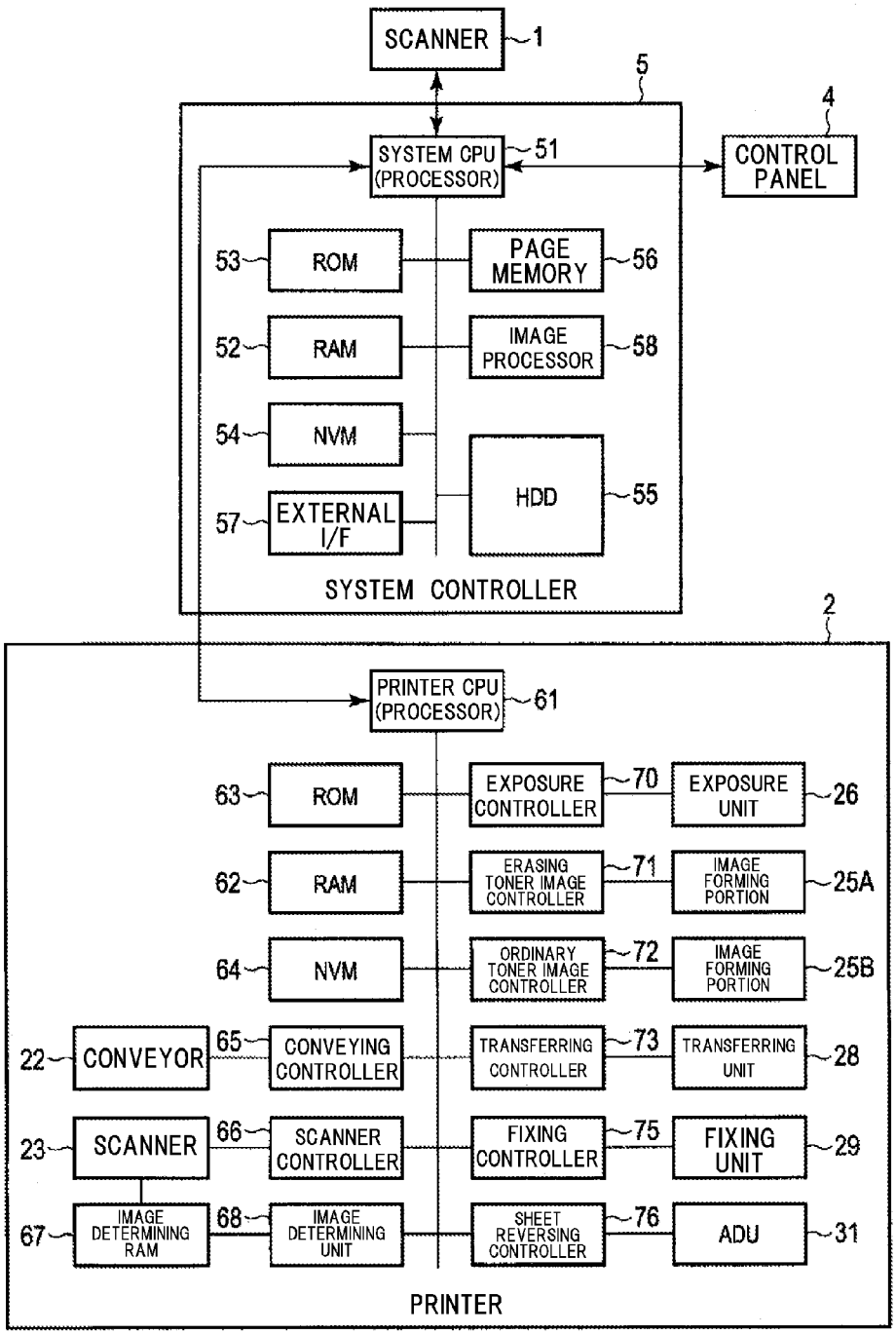
FIG. 2 is a block diagram to describe a configuration example of a control system in the digital multi-functional peripheral according to the embodiment.

FIG. 2 is a block diagram showing schematically a configuration example of a control system in the system controller 5 and the printer 2 of the digital multi-functional peripheral.

In the configuration example shown in FIG. 2, the system controller 5 has a system CPU (a processor) 51, a RAM 52, a ROM 53, a nonvolatile memory (NVM) 54, an HDD 55, a page memory 56, an external interface (I/F) 57 and an image processor 58.

The system CPU 51 totally controls the whole and the respective units of the digital multi-functional peripheral. The system CPU 51 is a processor which executes a program to thereby realize the processing. The system CPU 51 connects to the respective units in the apparatus through a system bus. The system CPU 51 connects to not only the respective units in the system controller 5, but also to the scanner 1, the printer 2, the control panel 4 and so on through the system bus. The system CPU 51 outputs an operation instruction to the respective units, and obtains various information from the respective units, by the two-way communication with the scanner 1, the printer 2, and the control panel 4. In addition, the system CPU 51 inputs information indicating detection signals and operation states of various sensors installed in the respective units in the apparatus.

The RAM 52 is composed of a volatile memory. The RAM 52 functions as a working memory, or a buffer memory. The ROM 53 is an unrewritable nonvolatile memory to store a program and control data and so on. The system CPU 51 executes the program stored in the ROM 53 (or the nonvolatile memory 54, the HDD 55) while using the RAM 52, to realize various processings. For example, the system CPU 51 executes the program, to function as extracting means and control means.

The nonvolatile memory (NVM) 54 is a rewritable nonvolatile memory. The nonvolatile memory 54 stores a control program which the system CPU 51 executes and control data. In addition, the nonvolatile memory 54 stores setting information, processing condition and so on. The hard disc drive (HDD) 55 is a large capacity storage device. The HDD 55 stores image data and various history information and so on. In addition, the HDD 55 may store a control program and control data and so on. In addition, the HDD 55 may store setting information and processing condition and so on.

The page memory 56 is a memory for expanding image data which is made the processing object. For example, the image data which the scanner 1 has read is subjected to the image processing, and then stored in the page memory 56. The image data stored in the page memory 56 is subjected to the image processing for printing, and is outputted to the printer 2, stored in the HDD 55, or transmitted to an external device through the external interface 57.

The external interface (I/F) 57 is an interface for communicating with an external device. For example, the external interface 57 receives print data in response to a print request from the external device. It is only necessary that the external interface 57 is an interface to perform data communication with the external device, and the external interface 57 may be one that is locally connected to the external device, or may be a network interface for communicating through a network.

The image processor 58 has functions as a scanner system image processing unit which processes an image read by the scanner 1 as an input image, a compression/expansion unit to perform compression or expansion of image data, and a printer system image processing unit which generates image data for printing which the printer 2 prints on a sheet. For example, the scanner system image processing unit (input image processing unit) has functions such as a shading correction processing, a gradation conversion processing, and an inter-line correction processing.

Next, a configuration example of a control system in the printer 2 will be described.

In the configuration example shown in FIG. 2, the printer 2 has, as the configuration of the control system, a printer CPU (processor) 61, a RAM 62, a ROM 63, a nonvolatile memory (NVM) 64, a conveying controller 65, a scanner controller 66, an image determining RAM 67, an image determining unit 68, an exposure controller 70, an erasing toner image controller 71, an ordinary toner image controller 72, a transferring controller 73, a fixing controller 75, a sheet reversing controller 76, and so on.

The printer CPU 61 manages control of the whole printer 2. The printer CPU 61 is a processor which executes a program to realize the processing. The printer CPU 61 connects to the respective units in the printer 2 through a system bus and so on. The printer CPU 61, in accordance with an operation instruction from the system CPU 51, outputs an operation instruction to the respective units in the printer 2, and notifies the system CPU 51 of various information obtained from the respective units.

The RAM 62 is composed of a volatile memory. The RAM 62 functions as a working memory or a buffer memory. The ROM 63 is an unrewritable nonvolatile memory to store a program and control data and so on. The printer CPU 61 executes the program stored in the ROM 63 (or the nonvolatile memory 64) while using the RAM 62, to realize various processings.

The nonvolatile memory (NVM) 64 is a rewritable nonvolatile memory. For example, the nonvolatile memory 64 stores a control program which the printer CPU 61 executes, and control data. In addition, the nonvolatile memory 64 may store setting information, processing condition and so on.

The conveying controller 65 controls the driving of the pick-up roller 21 and the conveyor 22. The conveying controller 65 controls the driving of the conveying roller as the conveyor 22 in the printer 2 in response to an operation instruction from the printer CPU 61. For example, the printer CPU 61, in response to a start instruction of the image decoloring processing or the image forming processing from the system controller 5, instructs a start of feeding a sheet by the pick-up roller 21 and the conveyor 22 to the conveying controller 65.

The scanner controller 66 controls the driving of the scanner 23. The scanner controller 66 reads an image on a sheet in response to an operation instruction from the printer CPU 61. For example, when the printer CPU 61 detects a sheet to be conveyed to the image reading position of the scanner 23 by a sensor not shown, the printer CPU 61 instructs a start of reading an image on the sheet to the scanner controller 66. In addition, in the case of storing the image data which the scanner 23 has read from a sheet, the scanner controller 66 transfers the image data read by the scanner 23 to the system controller 5 through the printer CPU 61 and so on. By this means, the image data on the sheet read by the scanner 23 can be stored in the HDD 55 and so on of the system controller 5.

In addition, the image determining RAM 67 stores the image data on the sheet which the scanner 23 has read. The image determining unit 68 determines the decolored state of the image in the sheet based on the image data (the read image on the sheet) stored in the image determining RAM 67. The image determining unit 68 notifies the printer CPU 61 of the determination result of the decolored state of the image in the sheet. In addition the image determining unit 68 may be realized by the printer CPU 61 with the program stored in the ROM 63 or the NVM 64.

The exposure controller 70 controls the exposure unit 26. The exposure controller 70 performs exposure control so as to form electrostatic latent images on the photoconductor drums of the image forming portions 25A, 25B by the exposure unit 26, in response to an operation instruction from the printer CPU 61. For example, the exposure controller 70 controls the laser light with which the exposure unit 26 irradiates the photoconductor drum, in accordance with the image data instructed by the printer CPU 61.

The erasing toner image controller 71 controls the driving of the image forming portion 25A. The erasing toner image controller 71, in response to an operation instruction from the printer CPU 61, performs control to develop the electrostatic latent image formed on the photoconductor drum of the image forming portion 25A with the decoloring toner. The ordinary toner image controller 72 controls the driving of the image forming portion 25B. The ordinary toner image controller 72, in response to an operation instruction from the printer CPU 61, performs control to develop the electrostatic latent image formed on the photoconductor drum of the image forming portion 25B with the ordinary toner. The transferring controller 73 controls the driving of the transferring unit 28 and the transfer current and so on. The transferring controller 73, in response to an operation instruction from the printer CPU 61, performs control to transfer the toner image transferred to the intermediate transferring belt 27 to a sheet by the transferring unit 28.

The fixing controller 75 controls the driving of the fixing unit 29. The fixing controller 75, in response to an operation instruction from the printer CPU 61, makes the heat roller 29*b* and the pressing roller 29*c* to be driven, and controls the heating unit 29*a*, to thereby control the surface temperature of the heat roller 29*b* to a desired temperature. For example, in the case of performing the fixing processing to make a decoloring toner image to be fixed on a sheet, the fixing controller 75 controls the heating unit 29*a* so that the heat roller 29*b* becomes the fixing temperature for the decoloring toner. In the case of performing the fixing processing to make an ordinary toner image to be fixed on a sheet, the fixing controller 75 controls the heating unit 29*a* so that the heat roller 29*b* becomes the fixing temperature for the ordinary toner. In addition, in the case of performing the decoloring processing to decolor a decoloring toner image on a sheet, the fixing controller 75 controls the heating unit 29*a* so that the heat roller 29*b* becomes the temperature for the decoloring processing (decoloring temperature).

The sheet reversing controller 76 controls the driving of the ADU 31. The sheet reversing controller 76, in response to an operation instruction from the printer CPU 61, performs control so as to resupply a sheet which has passed through the fixing unit 29 to a position in front of the image reading position of the scanner 23 by the ADU 31. For example, in the case of forming an image on a rear face of a sheet after fixing processing (in the case of performing double-side printing), the sheet reversing controller 76 performs driving control such that the sheet after the fixing processing is once conveyed to the sheet ejecting unit 30 side, and then the sheet is made to be switched back and is taken into the ADU 31. By this means, the sheet is resupplied to a position in front of the alignment roller 24 (in front of the image reading position of the scanner 23) with the face thereof in the reversed state. In addition, in the case of confirming the decolored state of the image in the sheet after the decoloring processing by the fixing unit 29, the sheet reversing controller 76 performs driving control so as to take the sheet after the decoloring processing into the ADC 31 in the unchanged state. By this means, the sheet is resupplied to a position in front of the image reading position of the scanner 23 without reversing the face.

Next, an operation of the digital multi-functional peripheral configured as described above will be described.

Here, it is assumed that a sheet on which an image has been printed with decoloring toner (a sheet which becomes an object of the decoloring processing), and a sheet which does not become an object of the decoloring processing (a new sheet, a sheet after decoloring processing, a sheet on which not decolorable image has been printed) are housed in the sheet feed cassette 20 in the mixed state.

In addition, it is assumed that the printer 2 of the digital multi-functional peripheral has a decoloring mode and an image forming mode, as the operation mode thereof. The decoloring mode is an operation mode to perform the decoloring processing to a sheet in the cassette 20 and eject the sheet to the sheet ejecting unit. The image forming mode is an operation mode to perform the decoloring processing to a sheet taken from the cassette 20 as necessary, and to form an image on the sheet after the decoloring processing (the sheet from which the image has been decolored) or a new sheet.

To begin with, an operation example of the decoloring mode will be described.

Figure 3:
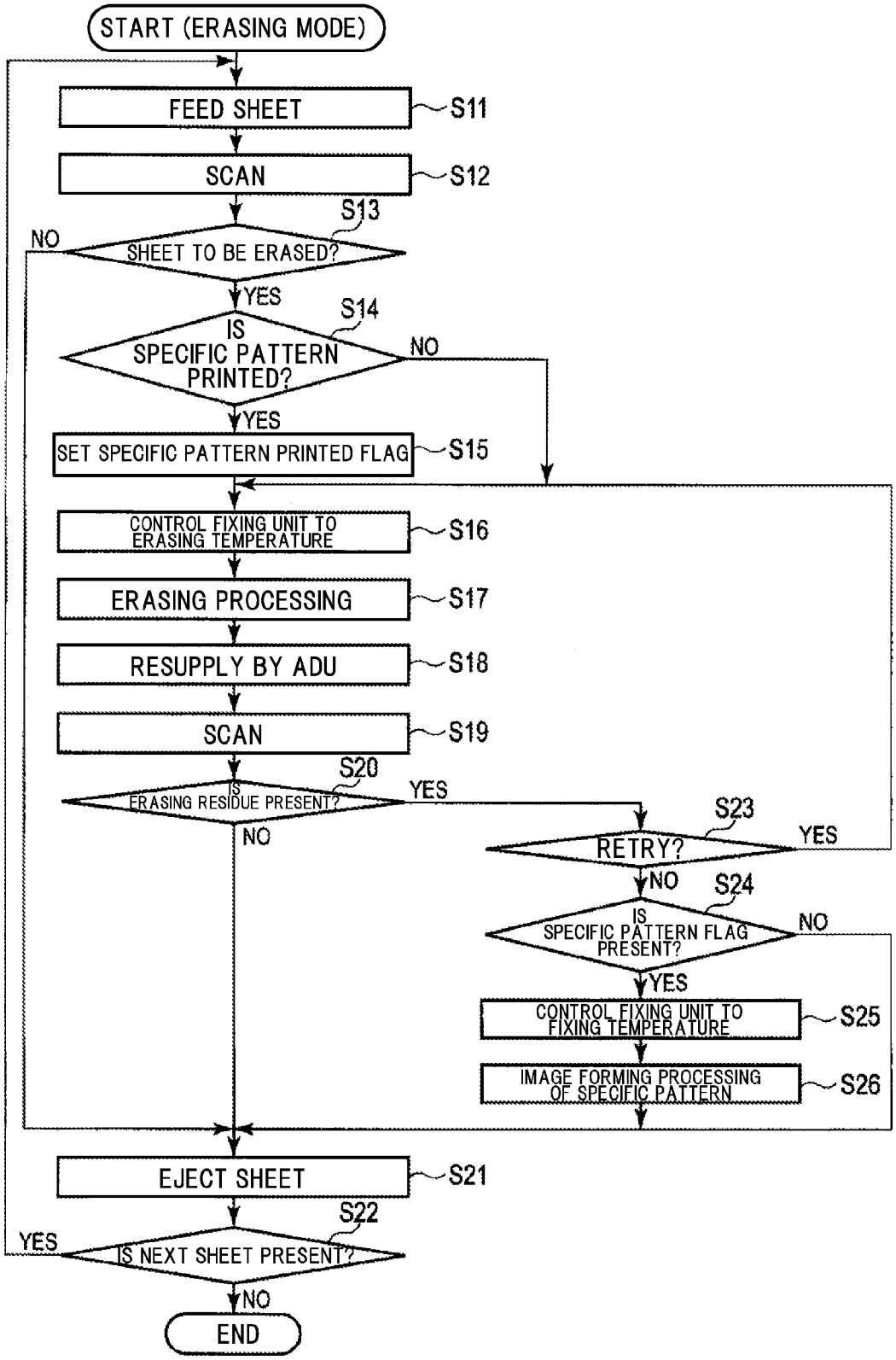
FIG. 3 is a flow chart to describe an operation example of a decoloring mode (an operation example of the image forming apparatus) in the digital multi-functional peripheral according to the embodiment.

FIG. 3 is a flow chart to describe the operation example of decoloring mode in the digital multi-functional peripheral.

For example, when a user wants to perform decoloring processing to a sheet in the cassette 20, the user selects a decoloring mode as the operation mode and selects a cassette which becomes an object of the decoloring processing, by the control panel 4. When the decoloring mode and the cassette are selected by the control panel 4, the system CPU 51 instructs the decoloring mode as the operation mode, and designates the cassette that is made the processing object, to the printer CPU 61.

The printer CPU 61, in response to the instruction from the system CPU 51, sets the operation mode and the cassette of the processing object. The printer CPU 61 sets the operation mode to the decoloring mode, and feeds a sheet from the cassette 20 which is made the object of the decoloring processing the conveyor 22 (step S11). The conveyor 22 conveys the fed sheet to the image reading position by the scanner 23 which functions as second image reading means. The scanner 23 reads an image on the sheet conveyed by the conveyor 22 (step S12). The scanner 23 stores the read image data on the sheet in the image determining RAM 67. The image determining unit 68 determines based on the image data stored in the image determining RAM 67 whether or not the relevant sheet is a sheet to be decoloring-processed (step S13). The image determining unit 68 determines whether or not the relevant sheet is a sheet to which the decoloring processing is to be performed based on whether or not a component of the decolorable image data exists in the image of the sheet read by the scanner 23. The image determining unit 68 notifies the printer CPU 61 of the information indicating whether or not the sheet is a sheet to which the decoloring processing is to be performed, as the determination result.

For example, the image determining unit 68 determines whether or not the relevant sheet is a sheet to which the decoloring processing is to be performed based on whether or not printed pixel components (pixel components except a base of the sheet) of not less than a prescribed amount exist in the read image data of the sheet. In addition, if the image determining unit 68 can detect a pixel formed with the decoloring toner, the image determining unit 68 may determine whether or not the sheet is a sheet to which the decoloring processing is to be performed based on whether or not a pixel component formed with the decoloring toner exists in the read image of the sheet.

When the image determining unit 68 determines that the fed sheet is not a sheet to which the decoloring processing is to be performed (step S13, NO), the image determining unit 68 notifies the printer CPU 61 of the information indicating the image determination result that the relevant sheet is not a sheet to which the decoloring processing is to be performed. Upon receiving the image determination result that the relevant sheet is not a sheet to which the decoloring processing is to be performed, the printer CPU 61 controls to make the conveyor 22 convey the relevant sheet, and thereby make the sheet pass through the transferring unit 28 and the fixing unit 29, and eject the relevant sheet to the sheet ejecting unit 30 (step S21). After the relevant sheet is ejected, if a next sheet is present in the cassette of the processing object (step 22, YES), the printer CPU 61 returns to the above-described step S11 to feed the next sheet, and if a next sheet is not present in the cassette of the processing object (step 22, NO), the printer CPU 61 finishes the processing by the decoloring mode.

In addition, when the image determining unit 68 determines that the fed sheet is a sheet to which the decoloring processing is to be performed (step S13, YES), the image determining unit 68 further determines whether or not a specific pattern is printed on the relevant sheet (step S14). For example, the specific pattern is a pattern image for preventing illegal copying. The image determining unit 68 determines whether or not the specific pattern is printed on the relevant sheet, based on whether or not a pattern image as the specific pattern exists in the read image of the sheet. In addition, if the image determining unit 68 can detect a pixel formed with the decoloring toner, the image determining unit 68 may determine whether or not the specific pattern formed with the decoloring toner exists in the read image of the sheet. In this case, the image determining unit 68 may determine whether or not the specific pattern is formed with the decoloring toner on the relevant sheet.

When the image determining unit 68 determines that the specific pattern is printed on the relevant sheet (step S14, YES), the image determining unit 68 notifies the printer CPU 61 of the information indicating the image determination result that the relevant sheet is a sheet on which a specific pattern is printed and to which the decoloring processing is to be performed. Upon receiving the image determination result that the relevant sheet is a sheet on which a specific pattern is printed and to which the decoloring processing is to be performed, the printer CPU 61, as the information to the relevant sheet, sets a specific pattern printed flag indicating that the specific pattern has been printed (step S15), and controls the fixing unit 29 to the decoloring temperature which can decolor the decoloring toner image formed on the sheet (step S16).

In addition, upon receiving the image determination result that the relevant sheet is a sheet on which a specific pattern is not printed and to which the decoloring processing is to be performed, from the image determining unit 68, the printer CPU 61 controls the fixing unit 29 to the decoloring temperature which can decolor the decoloring toner image formed on the sheet, without setting a specific pattern printed flag (step S16).

Having controlled the fixing unit 29 to the decoloring temperature, the printer CPU 61 performs the decoloring processing to the relevant sheet (step S17). As the decoloring processing, the printer CPU 61 makes the conveyor 22 convey the relevant sheet to the fixing unit 29 which is controlled to the decoloring temperature. The fixing unit 29 conveys the relevant sheet by the heat roller 29*b* which is heated to the decoloring temperature by the heating unit 29*a* and the pressing roller 29*c*, to thereby heat the relevant sheet at the decoloring temperature. The printer CPU 61 conveys the sheet (the sheet after the decoloring processing) which has been heated at the decoloring temperature by the fixing unit 29 to the ADU 31. The ADU 31 resupplies the sheet which has been conveyed after the decoloring processing to a position in front of the scanner 23 which functions as the image reading means (step S18). Here, the ADU 31 resupplies the sheet after the decoloring processing to a position at least in front of the image reading position of the scanner 23.

The printer CPU 61 makes the conveyor 22 convey the sheet resupplied by the ADU 31, and makes the scanner 23 read an image of the relevant sheet again. By this means, the scanner 23 reads the image of the sheet after the decoloring processing which has been conveyed to the image reading position (step S19). The scanner 23 stores the read image data on the sheet in the image determining RAM 67. The image determining unit 68, based on the image data stored in the image determining RAM 67, determines whether or not decoloring residue is present on the resupplied sheet (whether or not the decoloring to image has been decolored) (step S20). The image determining unit 68 notifies the printer CPU 61 of the information indicati whether or not the decoloring residue is present on the sheet, as the image determination result.

When the image determining unit 68 determines that the decoloring residue is not present on the resupplied sheet (the decoloring toner image has been decolored) (step S20, NO) the image determining unit 68 notifies the printer CPU 61 of the information indicating the image determination result that the decoloring residue is not present on the relevant sheet. Upon receiving the image determination result that the decoloring residue is not present on the relevant sheet, the printer CPU 61 makes the conveyor 22 convey the relevant sheet, and thereby makes the sheet pass through the transferring unit 28 and the fixing unit 29, and ejects the relevant sheet to the sheet ejecting unit 30 (step S21). After the relevant sheet is ejected, if a next sheet is present in the cassette of the processing object (step 22, YES), the printer CPU 61 returns to the above-described step S11 to feed the next sheet, and if a next sheet is not present in the cassette of the processing object (step 22, NO), the printer CPU 61 finishes the processing by the decoloring mode.

In addition, when the image determining unit 68 determines that the decoloring residue is present on the resupplied sheet (step S20, YES), the image determining unit 68 notifies the printer CPU 61 of the information indicating the image determination result that the decoloring residue is present on the relevant sheet. Upon receiving the image determination result that the decoloring residue is present on the relevant sheet, the printer CPU 61 determines whether or not the decoloring processing is performed again (retried) to the relevant sheet (step S23).

When the printer CPU 61 determines that the decoloring processing is performed again to the relevant sheet (step S23, YES), the printer CPU 61 returns to the step S16, controls the fixing unit 29 to the decoloring temperature, and performs the decoloring processing to the relevant sheet. In this case, the printer CPU 61 performs the processings of the above-described steps S16-S20 and S23 to the relevant sheet.

In addition, when the printer CPU 61 determines that the decoloring processing is not performed to the relevant sheet (step S23, NO), the printer CPU 61 determines whether or not the specific pattern flag is set for the relevant sheet (step S24). When the printer CPU 61 determines that the specific pattern flag is set for the relevant sheet (step S24, YES), the printer CPU 61 controls the fixing unit 29 to a fixing temperature so as to fix the toner (the ordinary toner or the decoloring toner) to the sheet (step S25), and performs the image forming processing of the specific pattern to the relevant sheet (step S26).

As the image forming processing of the specific pattern to the relevant sheet, the printer CPU 61 forms the toner image of the specific pattern on the intermediate transferring belt 27 by the image forming portion 25 and the exposure unit 26. Here, the specific pattern may be formed on the relevant sheet with the decoloring toner, or may be formed on the relevant sheet with the ordinary toner. The toner image of the specific pattern formed on the intermediate transferring belt 27 is transferred to the relevant sheet by the transferring unit 28. The sheet to which the toner image of the specific pattern has been transferred is subjected to the fixing processing by the fixing unit 29 which is controlled to the fixing temperature. With these processings, the specific pattern is printed on the relevant sheet.

That is, when the specific pattern flag is set for the sheet with the decoloring residue, the printer CPU 61 ejects the relevant sheet on which the specific pattern has been printed to the sheet ejecting unit 30 (step S21).

In addition, when the specific pattern flag is not set for the sheet with the decoloring residue, that is when the printing of the specific pattern to the relevant sheet is unnecessary (step S24, NO), the printer CPU 61 makes the conveyor 22 convey the relevant sheet, and thereby makes the relevant sheet pass through the transferring unit 28 and the fixing unit 29, and ejects the relevant sheet to the sheet ejecting unit 30 (step S21).

In the case of ejecting the relevant sheet, if a next sheet is present in the cassette of the processing object (step 22, YES), the printer CPU 61 returns to the above-described step S11 to feed the next sheet, and if a next sheet is not present in the cassette of the processing object (step 22, NO), the printer CPU 61 finishes the processing by the decoloring mode.

According to the processing in the decoloring mode as described above, the digital multi-functional peripheral as the image erasing apparatus, after having determined whether or nota specific pattern is formed on a fed sheet, performs the decoloring processing to decolor an image to the relevant sheet, confirms decoloring residue on the sheet to which the decoloring processing has been performed, and ejects the sheet confirmed to be a sheet on which the decoloring residue is not present. In addition, the image forming apparatus prints a specific pattern on the sheet which is confirmed to be a sheet with the decoloring residue, and on which the specific pattern has been formed before the decoloring processing, and then ejects the sheet.

By this means, it can be prevented that in the sheet on which the specific pattern has been printed with the decoloring toner, only the specific pattern is decolored by the decoloring processing, and only the image except the specific pattern which has been printed along with the specific pattern is illegally copied.

Next, an operation example of the image forming mode will be described.

Figure 4:
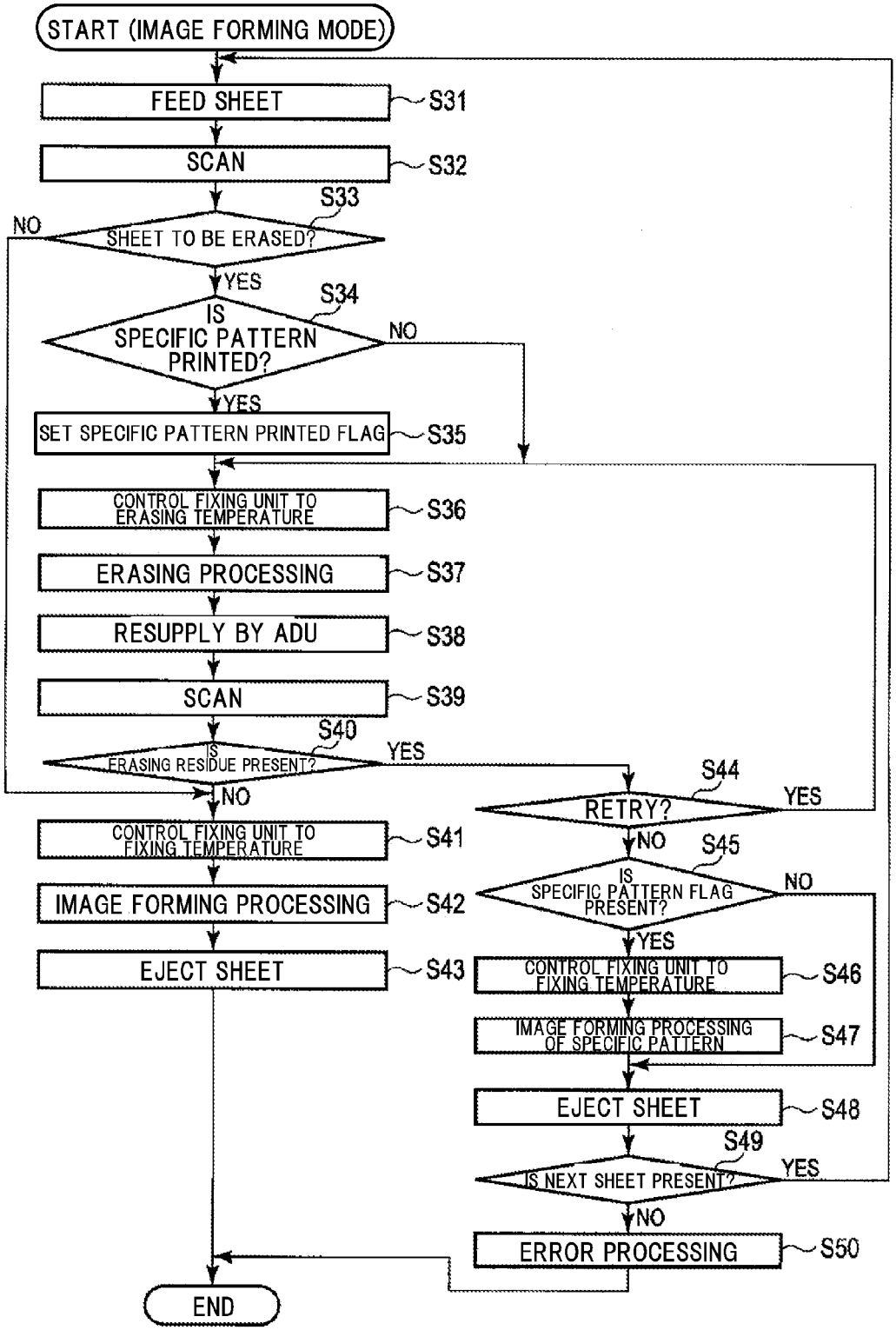
FIG. 4 is a flow chart to describe an operation example of an image forming mode (an operation example of the image forming apparatus) in the digital multi-functional peripheral according to the embodiment.

FIG. 4 is a flow chart to describe the operation example of the image forming mode.

For example, when a user wants to perform image forming processing using a sheet in the cassette 20, the user selects an image forming mode as the operation mode, and selects a cassette in which the sheet on which an image is to be formed is housed, by the control panel 4. When the image forming mode and the cassette are selected by the control panel 4, the system CPU 51 instructs the image forming mode as the operation mode, and designates the cassette that is made the processing object, to the printer CPU 61. Here, it is assumed that the sheet on which the image has been formed with the decoloring toner is housed (or mixed) in the cassette designated in the image forming mode.

The printer CPU 61 sets the operation mode to the image forming mode, in response to the instruction from the system CPU 51, and feeds a sheet from the cassette 20 by the conveyor 22 (step S31). The conveyor 22 conveys the sheet fed from the cassette 20 to the image reading position by the scanner 23 which functions as the second image reading means. The scanner 23 reads an image on the sheet conveyed by the conveyor 22 (step S32). The scanner 23 stores the read image data on the sheet in the image determining RAM 67. The image determining unit 68 determines based on the image data stored in the image determining RAM 67 whether or not the relevant sheet is a sheet to which the decoloring processing is to be performed (step S33). The image determining unit 68 determines whether or not the relevant sheet is a sheet to which the decoloring processing is to be performed based on whether or not a component of the decolorable image data exists in the image of the sheet read by the scanner 23. The image determining unit 68 notifies the printer CPU 61 of the information indicating whether or not the sheet is a sheet to which the decoloring processing is to be performed, as the determination result.

For example, the image determining unit 68 determines whether or not the sheet is a sheet to which the decoloring processing is to be performed based on whether or not printed pixel components (pixel components except a base of the sheet) of not less than a prescribed amount exist in the read image data of the sheet. In addition, if the image determining unit 68 can detect a pixel formed with the decoloring toner, the image determining unit 68 may determine whether or not a pixel component formed with the decoloring toner exists in the read image of the sheet. In this case, the sheet on which image data has been formed with the toner except the decoloring toner can be determined as not a sheet to which the decoloring processing is to be performed.

When the image determining unit 68 determines that the fed sheet is not a sheet to which the decoloring processing is to be performed, that is the fed sheet is a new sheet or a sheet after the image decoloring processing (step S33, NO), the image determining unit 68 notifies the printer CPU 61 of the information indicating the image determination result that the relevant sheet is not a sheet to which the decoloring processing is to be performed. Upon receiving the image determination result that the relevant sheet is not a sheet to which the decoloring processing is to be performed, the printer CPU 61 controls the fixing unit 29 to the fixing temperature so as to make the toner (the ordinary toner or the decoloring toner) to be fixed to the sheet (step S41), performs the image forming processing to the relevant sheet (step S42), ejects the image-formed sheet (step S43) and finishes the image forming processing.

In addition, when the image determining unit 68 determines that the fed sheet is a sheet to which the decoloring processing is to be performed (step S33, YES), the image determining unit 68 further determines whether or not a specific pattern is printed on the relevant sheet (step S34). For example, the specific pattern is a pattern image for preventing illegal copying. The image determining unit 68 determines whether or not the specific pattern is printed on the relevant sheet, based on whether or not a pattern image as the specific pattern exists in the read image of the sheet. In addition, if the image determining unit 68 can detect a pixel formed with the decoloring toner, the image determining unit 68 may determine whether or not the specific pattern formed with the decoloring toner exists in the read image of the sheet. In this case, the image determining unit 68 should determine whether or not the specific pattern is formed with the decoloring toner on the relevant sheet.

When the image determining unit 68 determines that the specific pattern is printed on the relevant sheet (step S34, YES), the image determining unit 68 notifies the printer CPU 61 of the information indicating the image determination result that the relevant sheet is a sheet on which a specific pattern is printed and to which the decoloring processing is to be performed. Upon receiving the image determination result that the relevant sheet is a sheet on which a specific pattern is printed and to which the decoloring processing is to be performed, the printer CPU 61, as the information to the relevant sheet, sets a specific pattern printed flag indicating that the specific pattern has been printed (step S35), and controls the fixing unit (erasing unit) 29 to the decoloring temperature which can decolor the decoloring toner image formed on the sheet (step S36).

In addition, upon receiving the image determination result that the relevant sheet is a sheet on which a specific pattern is not printed and to which the decoloring processing is to be performed, from the image determining unit 68, the printer CPU 61 controls the fixing unit 29 to the decoloring temperature which can decolor the decoloring toner image formed on the sheet, without setting a specific pattern printed flag (step S36).

Having controlled the fixing unit 29 to the decoloring temperature, the printer CPU 61 performs the decoloring processing to the relevant sheet (step S37). As the decoloring processing, the printer CPU 61 makes the conveyor 22 convey the relevant sheet to the fixing unit 29, and makes the fixing unit 29 heat the relevant sheet at the decoloring temperature. The printer CPU 61 conveys the sheet (the sheet after the decoloring processing) which has been heated at the decoloring temperature by the fixing unit 29 to the ADU 31. The ADU 31 resupplies the sheet which has been conveyed after the decoloring processing to a position in front of the scanner 23 which functions as the image reading means (step S38). Here, the ADU 31 resupplies the sheet after the decoloring processing to a position at least in front of the image reading position of the scanner 23.

The printer CPU 61 snakes the conveyor 22 convey the sheet resupplied by the ADU 31, and makes the scanner 23 read an image of the relevant sheet again. By this means, the scanner 23 reads the image of the sheet after the decoloring processing which has been conveyed to the image reading position (step S39). The scanner 23 stores the image data on the read sheet in the image determining RAM 67. The image determining unit 68, based on the image data stored in the image determining RAM 67, determines whether or not decoloring residue is present on the resupplied sheet (whether or not the decoloring toner image has be decolored) (step S40). The image determining unit 68 notifies the printer CPU 61 of the information indicating whether or not the decoloring residue is present on the sheet, as the image determination result.

When the image determining unit 68 determines that the decoloring residue is not present on the resupplied sheet (the decoloring toner image has been decolored) (step S40, NO), the image determining unit 68 notifies the printer CPU 61 of the information indicating the image determination result that the decoloring residue is not present on the relevant sheet. Upon receiving the image determination result that the decoloring residue is not present on the relevant sheet, the printer CPU 61 proceeds to the above-described step S41, controls the fixing unit 29 to the fixing temperature (step S41), performs the image forming processing to the relevant sheet (step S42), ejects the image-formed sheet (step S43), and finishes the image forming processing.

In addition, when the image determining unit 68 determines that the decoloring residue is present on the resupplied sheet (step S40, YES), the image determining unit 68 notifies the printer CPU 61 of the information indicating the image determination result that the decoloring residue is present on the relevant sheet. Upon receiving the image determination result that the decoloring residue is present on the relevant sheet, the printer CPU 61 determines whether or not the decoloring processing is performed again (retried) to the relevant sheet (step S44).

When the printer CPU 61 determines that the decoloring processing is performed to the relevant sheet again (step S44, YES), the printer CPU 61 returns to the step S36, controls the fixing unit 29 to the decoloring temperature, and performs the decoloring processing to the relevant sheet. In this case, the printer CPU 61 performs the processings of the above-described steps S36-S40 to the relevant sheet.

In addition, when the printer CPU 61 determines that the decoloring processing is not performed again to the relevant sheet (step S44, NO), the printer CPU 61 determines whether or not the specific pattern flag is set to the relevant sheet (step S45). When the printer CPU 61 determines that the specific pattern flag is set for the relevant sheet (step S45, YES), the printer CPU 61 controls the fixing unit 29 to a fixing temperature so as to fix the toner (the ordinary toner or the decoloring toner) to the sheet (step S46), and performs the image forming processing of the specific pattern to the relevant sheet (step S47).

As the image forming processing of the specific pattern to the relevant sheet, the printer CPU 61 forms the toner image of the specific pattern on the intermediate transferring belt 27 by the specific pattern image forming portion 25 and the exposure unit 26. Here, the specific pattern may be formed on the relevant sheet with the decoloring toner, or may be formed on the relevant sheet with the ordinary toner. The toner image of the specific pattern formed on the intermediate transferring belt 27 is transferred to the relevant sheet by the transferring unit 28. The sheet on which the toner image of the specific pattern has been transferred is subjected to the fixing processing by the fixing unit 29 which is controlled to the fixing temperature. With these processings, the specific pattern is printed on the relevant sheet.

In addition, the printer CPU 61 ejects the sheet on which the specific pattern has been printed to the sheet ejecting unit 30 (step S48). In the example shown in FIG. 4, it is assumed that the sheet on which the decoloring residue is present and the specific pattern has been printed is ejected, and a next sheet is fed from the designated cassette and the above-described processing is performed to the next sheet. That is, in the case of printing the specific pattern and ejecting the sheet, if a next sheet is present in the cassette of the processing object (step S49, YES), the printer CPU 61 returns to the above-described step S31 to feed the next sheet, and if a next sheet is not present in the cassette of the processing object (step S49, NO), the printer CPU 61 performs an error processing required by that the usable sheet is not present (step S50), and finishes the image forming processing.

In addition, when the specific pattern flag is not set for the sheet with the decoloring residue, that is when the printing of the specific pattern to the relevant sheet is unnecessary (step S45, NO), the printer CPU 61 makes the conveyor 22 convey the relevant sheet, and thereby makes the relevant sheet pass through the transferring unit 28 and the fixing unit 29, and ejects the relevant sheet to the sheet ejecting unit 30 (step S48). Also in this case, if a next sheet is present in the designated cassette (step S49, YES), the printer CPU 61 returns to the above-described step S31 to feed the next sheet, and if a next sheet is not present in the designated cassette (step S49, NO), the printer CPU 61 performs the error processing (step S50), and finishes the image forming processing.

According to the processing in the image forming mode as described above, the digital multi-functional peripheral as the image forming apparatus, after having determined whether or not a specific pattern is formed on a fed sheet, performs the decoloring processing to decolor an image to the relevant sheet, and confirms decoloring residue on the sheet to which the decoloring processing has been performed. When the image forming apparatus confirms that the decoloring residue is not present, or determines that the sheet is not a sheet to which the decoloring processing is to be performed, the image forming apparatus performs the image forming processing to the relevant sheet. In addition, the image forming apparatus prints the specific pattern on the sheet which is confirmed to be a sheet with the decoloring residue, and on which the specific pattern has been formed before the decoloring processing, and ejects the sheet.

By this means, it can be prevented that the sheet on which the specific pattern has been printed with the decoloring toner is reused in the state in which only the specific pattern is decolored by the decoloring processing.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image erasing apparatus, comprising:

an erasing unit to perform erasing processing to a sheet on which a specific pattern is formed with decoloring toner;

a reading unit to read an image on the sheet to which the erasing processing is performed by the erasing unit;

a detecting unit to detect erasing residue on the sheet, based on the image read by the reading unit; and a specific pattern forming unit to form the specific pattern again on the sheet, when the erasing residue is detected by the detecting unit.

2. The apparatus of claim 1, wherein the detecting unit detects whether or not a part of an image except the specific pattern remains on the sheet, based on the image read by the reading unit.

3. The apparatus of claim 1, further comprising:

a second reading unit to read an image on a fed sheet; and a determining unit to determine whether or not the sheet is a sheet to be made an erasing processing object, based on the image read by the second reading unit;

wherein the erasing unit performs the erasing processing to the sheet which is determined by the determining unit as the sheet to be made the erasing processing object.

4. The apparatus of claim 3, further comprising:

a second determining unit to determine whether or not the specific pattern is formed on the sheet based on the image read by the second reading unit;

wherein the specific pattern forming unit forms the specific pattern on the sheet which is determined by the second determining unit as the sheet on which the specific pattern is formed, out of the sheets in each of which the erasing residue is detected by the detecting unit.

5. An image forming apparatus, comprising:

an erasing unit to perform erasing processing to a sheet on which a specific pattern is formed with decoloring toner;

a reading unit to read an image on the sheet to which the erasing processing is performed by the erasing unit;

a detecting unit to detect erasing residue on the sheet, based on the image read by the reading unit;

an image forming unit to form an image to the sheet in which the erasing residue is not detected by the detecting unit; and a specific pattern forming unit to form the specific pattern on the sheet in which the erasing residue is detected by the detecting unit.

6. The apparatus of claim 5, further comprising:

a second reading unit to read an image on a fed sheet; and a determining unit to determine whether or not the sheet is a sheet to be made an erasing processing object, based on the image read by the second reading unit;

wherein the erasing unit performs the erasing processing to the sheet which is determined by the determining unit as the sheet to be made the erasing processing object; and the image forming unit forms the image to the sheet which is determined by the determining unit as the sheet not to be made the erasing processing object, or the sheet in which the erasing residue is not detected by the detecting unit.

7. An image erasing method, comprising:

performing erasing processing to a sheet on which a specific pattern is formed with decoloring toner;

reading an image on the sheet to which the erasing processing is performed;

detecting erasing residue on the sheet, based on the read image; and forming the specific pattern again on the sheet, when the erasing residue is detected.

8. The method of claim 7, wherein the detecting step detects whether or not a part of an image except the specific pattern remains on the sheet, based on the read image.

9. The method of claim 7, further comprising:

reading an image on a fed sheet; and determining whether or not the sheet is a sheet to be made an erasing processing object, based on the read image;

wherein the erasing processing is performed to the sheet which is determined as the sheet to be made the erasing processing object.

10. The method of claim 9, further comprising:

determining whether or not the specific pattern is formed on the sheet based on the read image;

wherein the specific pattern is formed on the sheet which is determined as the sheet on which the specific pattern is formed, out of the sheets in each of which the erasing residue is detected.

* * * * *